US007296697B2

(12) United States Patent
Costa et al.

(10) Patent No.: US 7,296,697 B2
(45) Date of Patent: Nov. 20, 2007

(54) ADJUSTABLE CLOSET ORGANIZER SYSTEM

(75) Inventors: Frazer Costa, North Canton, OH (US); Radu Ghiorghie, Mogodore, OH (US); Anthony Marchetta, Medina, OH (US); Gina Rodi, Wooster, OH (US); David M. Stitchick, Wooster, OH (US); Sean O'Brien, Corvallis, OR (US)

(73) Assignee: Rubbermaid Incorporated, Fairlawn, OH (US)

( * ) Notice: Subject to any disclaimer, the term of this patent is extended or adjusted under 35 U.S.C. 154(b) by 71 days.

(21) Appl. No.: 10/740,933

(22) Filed: Dec. 18, 2003

(65) Prior Publication Data

US 2005/0011420 A1 Jan. 20, 2005

Related U.S. Application Data

(60) Provisional application No. 60/434,470, filed on Dec. 18, 2002.

(51) Int. Cl.
*A47F 5/08* (2006.01)

(52) U.S. Cl. ..... 211/175; 211/90.02; 211/90.03; 211/94.02; 211/187; 248/323; 248/214

(58) Field of Classification Search ..... 211/187, 211/190, 191, 192, 123, 105.1, 134, 153, 211/90.01, 90.03, 90.04, 113, 117, 118; 108/108, 108/29; 248/225.21, 323, 214
See application file for complete search history.

(56) References Cited

U.S. PATENT DOCUMENTS 303,474 A 8/1884 Webb
1,611,397 A 12/1926 Wells
2,622,834 A 12/1952 Sparring
2,827,254 A * 3/1958 Faber ..... 248/243
3,288,489 A 11/1966 Jahn
3,353,684 A 11/1967 Chesley
3,671,062 A 6/1972 Ashworth
3,698,329 A 10/1972 Diamond et al.
3,717,256 A 2/1973 McKinnon
3,915,097 A 10/1975 Young, Jr.
3,966,158 A 6/1976 Boundy
3,993,002 A * 11/1976 Stroh ..... 108/108
4,098,480 A 7/1978 Neumann
4,098,481 A 7/1978 Johnson et al.

(Continued)

OTHER PUBLICATIONS

PCT International Preliminary Examination Report issued in PCT/US03/40500, mailed Aug. 30, 2004.

(Continued)

*Primary Examiner*—Richard E. Chilcot, Jr.
*Assistant Examiner*—Jared W. Newton
(74) *Attorney, Agent, or Firm*—Marshall, Gerstein & Borun LLP

(57) ABSTRACT

An organizer system has a length adjustable horizontal top rail, a plurality of length adjustable vertical uprights, and a plurality of mounting brackets attachable to the uprights. The mounting brackets are mounted to the uprights at any of multiple optional desired locations. One or more shelves are mounted to the mounting brackets. The shelf width is adjustable to virtually any width from a minimum single shelf width by using two or more of the shelves. Storage accessories can be mounted to the system and can include shoe storage shelves, shoe storage racks, clothes hanging rods, vertical storage devices, and forwardly and rearwardly slidable storage devices.

17 Claims, 12 Drawing Sheets

U.S. PATENT DOCUMENTS 4,267,931 A * 5/1981 Belotta ..... 211/153
4,311,295 A 1/1982 Jamar, Jr.
4,335,973 A 6/1982 Beck et al.
4,406,374 A 9/1983 Yedor
4,500,146 A 2/1985 Peterson
4,516,874 A 5/1985 Yang et al.
4,553,523 A * 11/1985 Stohrer, Jr. ..... 126/9 B
D286,495 S * 11/1986 Blomdahl ..... D8/373
4,620,489 A 11/1986 Albano
4,624,376 A * 11/1986 Bertram ..... 211/187
4,658,968 A 4/1987 Mastrodicasa
4,967,916 A 11/1990 Handler et al.
5,018,323 A 5/1991 Clausen
5,022,621 A 6/1991 Quest
5,050,832 A 9/1991 Lee et al.
5,110,080 A * 5/1992 Rieman ..... 248/225.11
5,127,762 A * 7/1992 Havlovitz ..... 403/298
5,144,780 A * 9/1992 Gieling et al. ..... 52/298
5,185,971 A * 2/1993 Johnson, Jr. ..... 52/36.6
D342,015 S * 12/1993 Andrejew ..... D8/373
5,346,077 A 9/1994 Randall
5,351,842 A * 10/1994 Remmers ..... 211/90.03
5,364,052 A * 11/1994 De Gruttis ..... 248/245
5,388,709 A 2/1995 Adams
5,421,646 A * 6/1995 McNamara et al. ..... 312/205
5,472,103 A * 12/1995 Merl ..... 211/187
5,538,213 A * 7/1996 Brown ..... 248/222.11
5,580,018 A * 12/1996 Remmers ..... 248/235
5,597,077 A 1/1997 Hartmann
5,738,019 A 4/1998 Parker
5,788,192 A * 8/1998 Poole, Jr. ..... 248/49
5,875,895 A 3/1999 Dardashti
5,988,409 A * 11/1999 Gusdorf et al. ..... 211/90.01
6,024,333 A 2/2000 Raasch et al.
6,123,303 A * 9/2000 Huang ..... 248/241
6,168,032 B1 1/2001 Merl
6,193,085 B1 * 2/2001 Nook et al. ..... 211/187
6,227,506 B1 * 5/2001 Benedict ..... 248/249
6,302,282 B1 10/2001 Gay et al.
6,315,134 B1 * 11/2001 Stuart ..... 211/87.01
6,332,548 B1 * 12/2001 West et al. ..... 211/175
6,402,108 B1 6/2002 Remmers
6,663,201 B2 * 12/2003 Herron et al. ..... 312/245
6,685,037 B1 * 2/2004 Zadak ..... 211/184
6,688,568 B1 * 2/2004 Moufflet ..... 248/225.11
6,726,035 B2 * 4/2004 Zadak ..... 211/90.03
6,786,337 B2 * 9/2004 Klein et al. ..... 211/34
6,854,919 B2 * 2/2005 Neumann et al. ..... 403/326
6,932,225 B2 * 8/2005 Rowe ..... 211/90.02
6,969,036 B2 * 11/2005 Magnusson ..... 248/339
7,086,544 B1 * 8/2006 Doench ..... 211/105.1
2002/0148796 A1 10/2002 Lin
2004/0007549 A1 1/2004 Klein et al.
2005/0011420 A1 1/2005 Costa et al.
2005/0109720 A1 5/2005 Marchetta
2005/0109901 A1 5/2005 Stitchick et al.
2005/0145147 A1 7/2005 Costa et al.
2005/0145588 A1 7/2005 Stitchick et al.
2005/0150436 A1 7/2005 Marchetta et al.
2005/0150850 A1 7/2005 Stitchick et al.

OTHER PUBLICATIONS

PCT International Search Report issued in PCT/US03/40500, mailed Oct. 5, 2004.

"Closet Space—The Final Frontier", LOWE'S® Home Improvement Warehouse Internet website, allegedly dated Feb. 19, 2002, pp. 1-3.

* cited by examiner

ADJUSTABLE CLOSET ORGANIZER SYSTEM

RELATED APPLICATION DATA

This application claims priority from U.S. Provisional Application Ser. No. 60/434,470, which was filed on Dec. 18, 2002.

BACKGROUND OF THE INVENTION

1. Field of the Invention

The present disclosure is generally related to organizers for storage, and more particularly to an adjustable and reconfigurable organizer system for closets and the like.

2. Background of the Invention

Storage organizers, shelving units, and other storage systems are known in the art. Some are adjustable and can be arranged and configured in various ways prior to or during installation, within a storage space such as a closet. However, such systems typically cannot be readjusted or easily rearranged after installation. Further, only portions of these systems and organizers are adjustable, such as with respect to the number of shelves and/or shelf location.

Many examples of shelving systems are known to have vertical risers with multiple perforations provided therein. Once the risers are installed on a wall surface, shelf mounting brackets are mounted on the risers where a shelf is desired. The brackets are provided with hooks shaped for being received in the perforations. The hooks are typically L-shaped such that when received in the perforations, the hooks hold the bracket in the installed position. The brackets are typically designed for a shelf to either merely rest directly on the bracket top surface, or be fastened to the bracket.

Known storage organizers are not typically provided with different types of storage structures. A typical shelving unit comes with shelves and the hardware to mount shelves. Conventional storage organizers are not designed or configured to accommodate different types of storage structures and accessories in the same unit.

BRIEF DESCRIPTION OF THE DRAWINGS

Objects, features, and advantages of the present invention will become apparent upon reading the following description in conjunction with the drawing figures, in which.

DETAILED DESCRIPTION OF THE INVENTION

The present invention is directed to an organizer system that is highly adjustable and reconfigurable either before, during, or after installation. The organizer system and its many variations disclosed herein provide a storage solution that is highly versatile and that can be individually customized for virtually any consumers storage needs. The disclosed organizer basic system provides shelving for storage. However, the system can also accommodate clothes hanging. The shelf and optional clothes hanging rod structures can be arranged in a vast array of different configurations.

To add further versatility, the disclosed organizer also can accommodate myriad storage accessories such as storage baskets, shoe storage shelves, shoe racks, and other storage accessories mountable to the basic system. The accessories can be mounted easily and directly to the basic system. The accessories can also be arranged in a wide variety of configurations as desired.

The organizer system and features disclosed herein solve many known problems with existing storage systems in units. The disclosed organizer system can be arranged to accommodate virtually any storage need, to fit in virtually any storage space that is at least large enough to install the minimum basic components, and can be customized utilizing the disclosed or other accessories to store virtually any item. The organizer system disclosed herein can be utilized in closets where it would be particularly well suited. However, the storage system can be mounted in virtually any space that can be used for storage, such as a shed, a laundry room, a basement corner, a garage, or the like.

Figure 1:
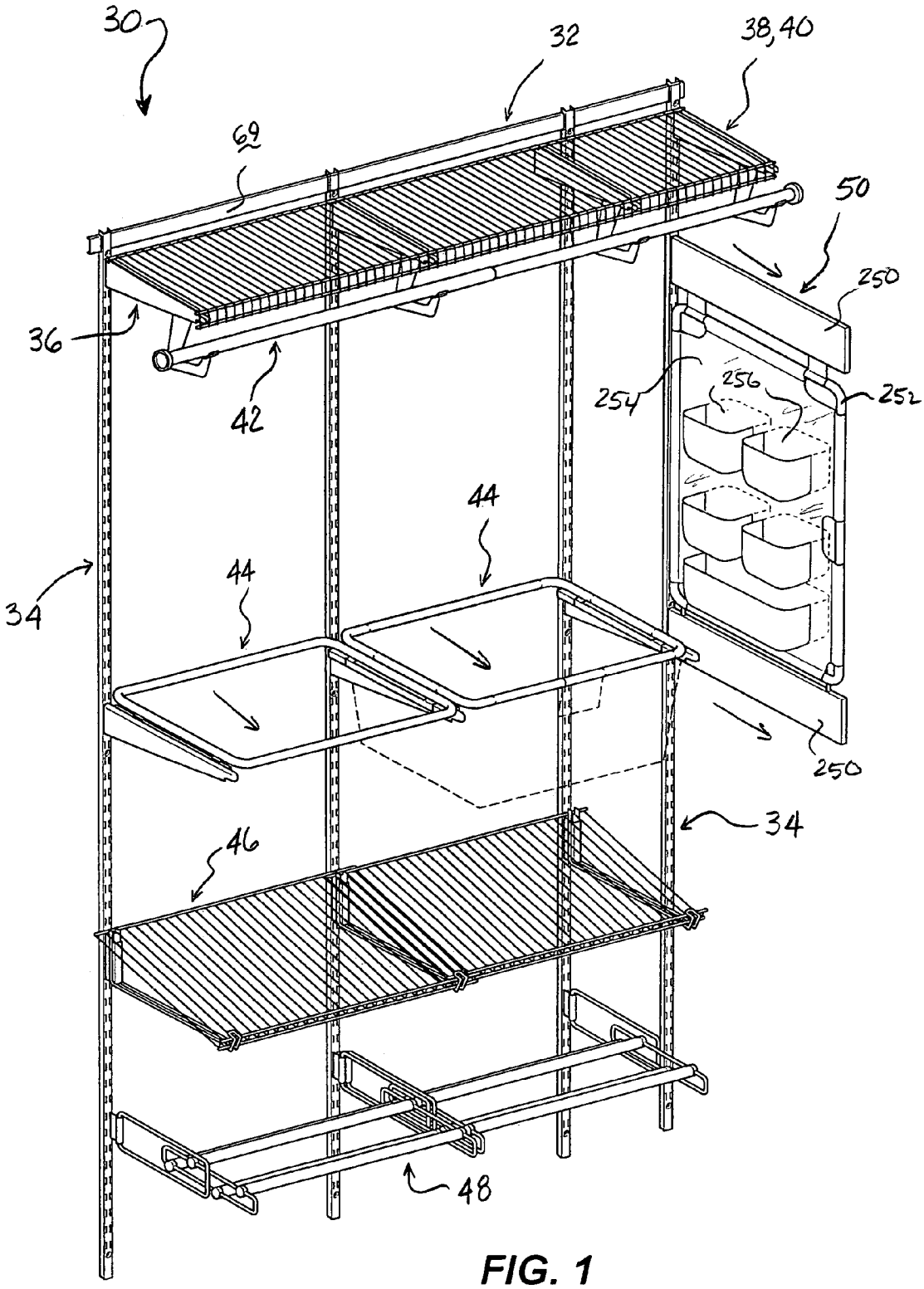
FIG. 1 shows a perspective view of an adjustable and reconfigurable closet organizer system constructed in accordance with the teachings of the present invention.

Referring now to the drawings, FIG. 1 generally illustrates a storage unit or organizer system 30 constructed in accordance with the teachings of the present invention. The organizer system 30 generally has a number of basic components including a length adjustable, horizontal top rail assembly 32. As described below, the top rail assembly 32 can be expanded laterally from a minimum length of a single rail component to virtually any length desired utilizing two or more rail components. The system 30 also has a plurality of vertical uprights 34 mounted to and suspended from the top rail assembly 32. Two or more of the uprights can be mounted laterally spaced apart and extending downward from the top rail assembly 32. The uprights are adapted to support the various components of the system and can be adapted to extend over a variety of vertical heights or lengths as explained below. The disclosed organizer system 30 also includes a plurality of shelf mounting brackets 36 mounted to the uprights at desired locations. The system further has a plurality of wire shelves 38 and 40 supportable by the mounting brackets 36. The shelves 38 and 40 provide for width adjustment from a minimum width of a single shelf to virtually any width desired utilizing two or more shelf components also as discussed below.

In addition to the basic system components noted above, the disclosed organizer system 30 also can include a plurality of optional accessories. The basic system can be adapted for mounting one or more optional clothes hanging rods 42. The system can be further adapted to accommodate one or more additional optional accessories such as storage baskets 44, shoe racks 46, shoe shelves 48, vertically oriented side sliders 50, or the like. Though not disclosed or described herein, any number of other accessories can be provided for use with and mounting directly on the basic system or indirectly via another optional accessory. Further, though the shelves are described as basic system components, the system can also be configured using only one or more storage accessories mounted to the uprights with no shelves installed.

Figure 4:
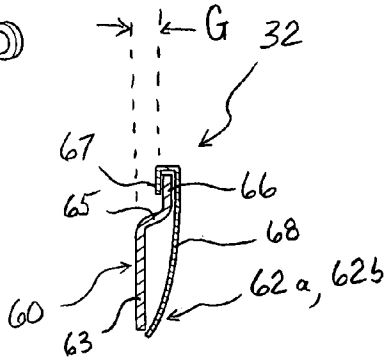
FIG. 4 shows a cross section of the top rail assembly taken along line IV-IV of the organizer system of FIG. 1.
Figure 2:
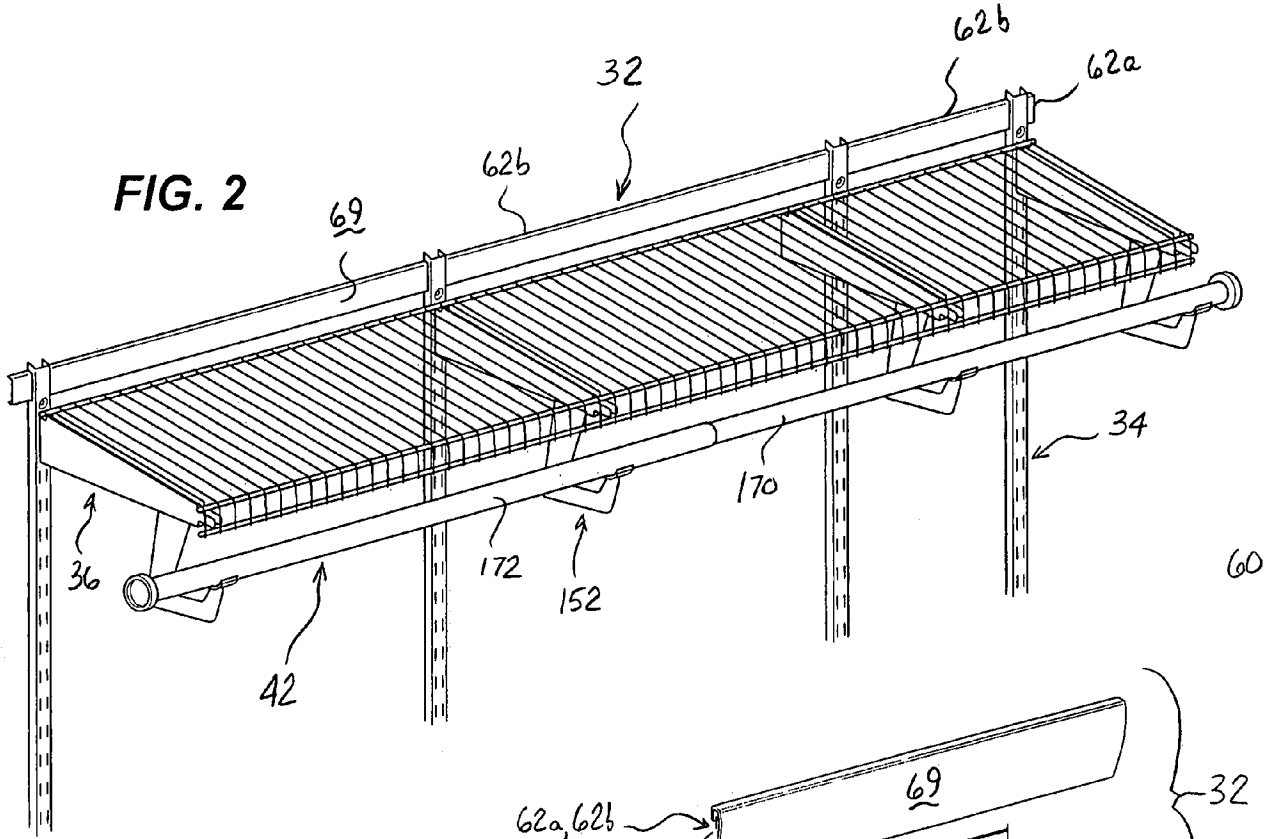
FIG. 2 shows an enlarged perspective view of an upper shelf portion of the organizer system shown in FIG. 1.
Figure 3:
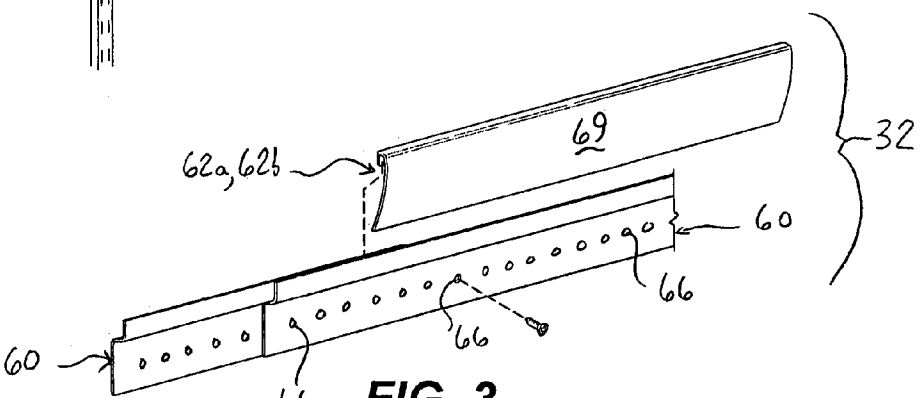
FIG. 3 shows a perspective and exploded view of a portion of the top rail assembly of the organizer system shown in FIG. 1.

As shown in FIGS. 2-4, the top rail assembly 32 is formed, in this example, having a plurality of substantially rigid support rail segments 60 constructed for mounting to a wall or other mounting surface. The top rail assembly 32 also includes, in this example, a plurality of decorative covers 62*a* and 62*b* that attach to the support rail segments 60. Aside from use as a decorative feature covering the support rail 60, the covers 62*a* and 62*b* also are used in the disclosed example as spacers for assisting a consumer in assembling and installing the system. The covers come in at least two lengths including at least one initial cover 62*a* and plural intermediate covers 62*b*. The purpose and function of the different length initial and intermediate covers are discussed below in greater detail. Though the materials and construction of the support rail 60 and the covers 62*a* and 62*b* can vary, in one example, the support rail 60 is a metal structural component and the covers are plastic decorative components.

As shown in FIGS. 3 and 4, each support rail segment 60 has a mounting section 63 that is generally planar and extends the length of the support rail and defines its bottom edge and part of the rail height. The rail segments 60 are adapted to mount the top rail assembly 32 to a mounting surface. The mounting section of each segment 60 has a plurality of openings 64, which in this example are spaced 1 inch apart over the length of each rail segment. Fasteners of any type can be used to mount the rail segments to a mounting surface. The invention is not to be limited to any particular type of mounting used for the rail segments.

Each rail segment also has a step 65 and a support leg 66 extending upward from the step. In this example, the support leg 66 is generally parallel to the mounting section 63 but spaced in a different plane. When mounted to a surface, the support leg is spaced forward from the mounting surface creating a gap G. This gap and the support leg 66 support the uprights 34 in this example. Other non-linear segmented configurations of the rail segments 60 can also be utilized.

Each cover 62*a* and 62*b* be in this example has a downwardly extending mounting flange 67 that is spaced rearward from a body 68 of the cover and extends over its length. The flange can be continuous or can be segmented into a number of discrete tabs if desired. The flange 67 is hooked over the mounting leg 66 of a rail segment 60 and received in the gap G when installed. The body 68 is sized in this example to cover the exposed rail segments and fasteners. As shown in one example of FIG. 1, the cover body 68 can be define a flat front facing surface 69. As shown in FIG. 4, the body can define a curved surface. As will be evident to those having ordinary skill in the art, the cover can be of virtually any configuration or construction and perform the aesthetic purpose of hiding the rail segments 60 and fasteners. Decorative features can also be added to the front facing surface to achieve virtually any desired appearance.

As shown in FIG. 3, the top rail 32 is length adjustable by placing two adjacent rail segments 60 in an overlapping relationship. Depending upon the amount of overlap of the tow two segments, their combined length can be selected. Adding additional segments permits creating a longer top rail. Any top rail 32 length, from one segment length or longer, can be achieved as desired.

Figure 5:
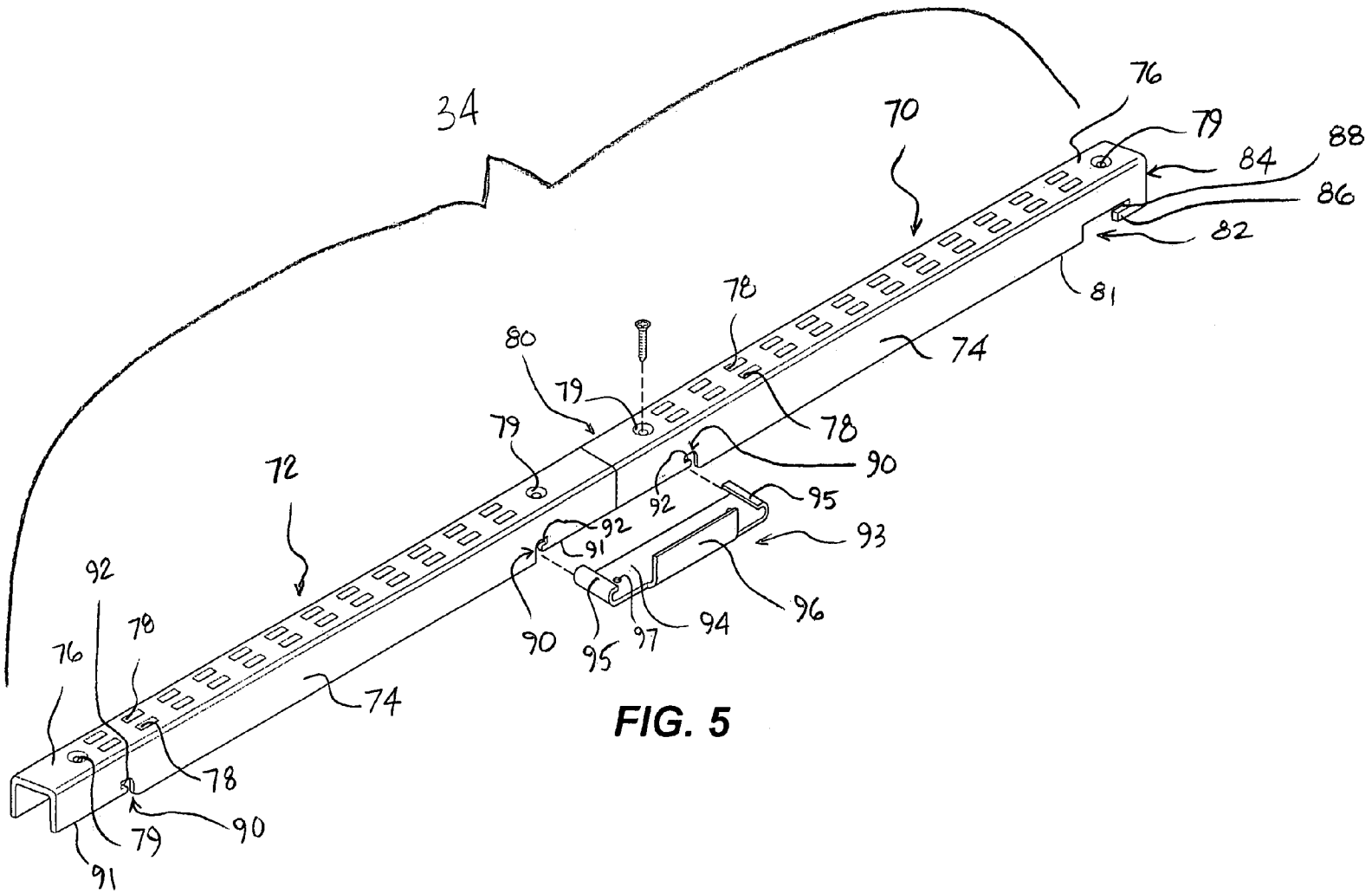
FIG. 5 shows a perspective and partially exploded view of an upright of the organizer system as shown in FIG. 1.

As shown in FIG. 5, the uprights 34, in one example, are provided as a plurality of upright segments including upper segments 70, adapted for attaching to the top rail segments 60, and supplemental segments 72 adapted for connection to the upper segments 70 and to each other. Utilizing an upper segment 70 or a combination of one upper segment and one or more supplemental segments in series permits achieving a suitable upright length or height for a given storage application.

Each upper segment 70 in one example is shorter in length than the supplemental segments 72. Each of the supplemental segments 72 is of the same length. However, different length variations can be utilized such as providing all segments of the same length, upper segment being longer than the supplemental segments, or a variety of different length segments.

As illustrated in FIG. 5, each of the upright segments 70 and 72 is, in this example, a U-shaped channel with two side surfaces 74 and a forward facing or front surface 76. Pairs of laterally spaced apart apertures 78 are provided in the front surface and oriented in a longitudinal direction and spaced apart over the length of the segments. The front surface 76 of each segment also includes a pair fastener openings 79, one each space from an end of the segment in this example. The segments can be secured to or at least retained in position against a mounting surface utilizing fasteners received through these openings 79. The upper segments may only have a single opening 79 near a lower end 80.

In this example, each of the shorter upper segments 70 includes a cut out section 82 in the free edge 81 of each of the opposed the side surfaces 74 adjacent a top end 84 of the segments. The cut outs 82 mirror one another and have an upward portion with a downwardly extending tab 86 defining an upward extending notch 88. The tab is hooked over the support leg 66 of a rail segment 60 for securing the segment to the top rail 32. The remaining portion of the cutout can be configured to follow the contour of the top rail segments 60. The notch can be sized to create a slight friction fit between the upright segment 70 and the rail segment 60 when assembled.

As shown in FIG. 5, the lower end 80 of the upper segments and each end of the supplemental segments 72 also include similar but smaller cutouts 90 in the free edge of the side surfaces 74. Each of these cut outs is an L-shaped opening also defining a notch 92 the extends in a direction toward its respective segment end. As shown, when two segments are abutted together, whether it be two segments 72 or one segment 72 with the bottom end of a segment 70, the notches 92 extend toward one another.

Clips 93 are disclosed herein for securing two adjacent and end-to-end abutting upright segments together. Each clip 93 has an elongate body 94, a pair of identically curved J-shaped hooks 95, one at each end of the body, and a bearing plate 96. The bearing plate 96 extends from one edge of the clip body 94 and is oriented perpendicular thereto. The hooks 95 are shaped to be received one each in one of the notches of the abutting segments. When fully installed, the bearing plate 96 will bear against a portion of the side surface 74 of each segment. The clip will loosely hold the two segments in end-to-end engagement until fasteners are used to secure the segments to the mounting surface. The side surface free edges at the ends of the abutting segments define recessed portions 91 recessed toward the front surface so that the clip 93 will rest flush with the free edges. Holes 97 in the clips 93 align with the corresponding openings 79 in each abutting segment to facilitate installation.

Figures 6, 7:
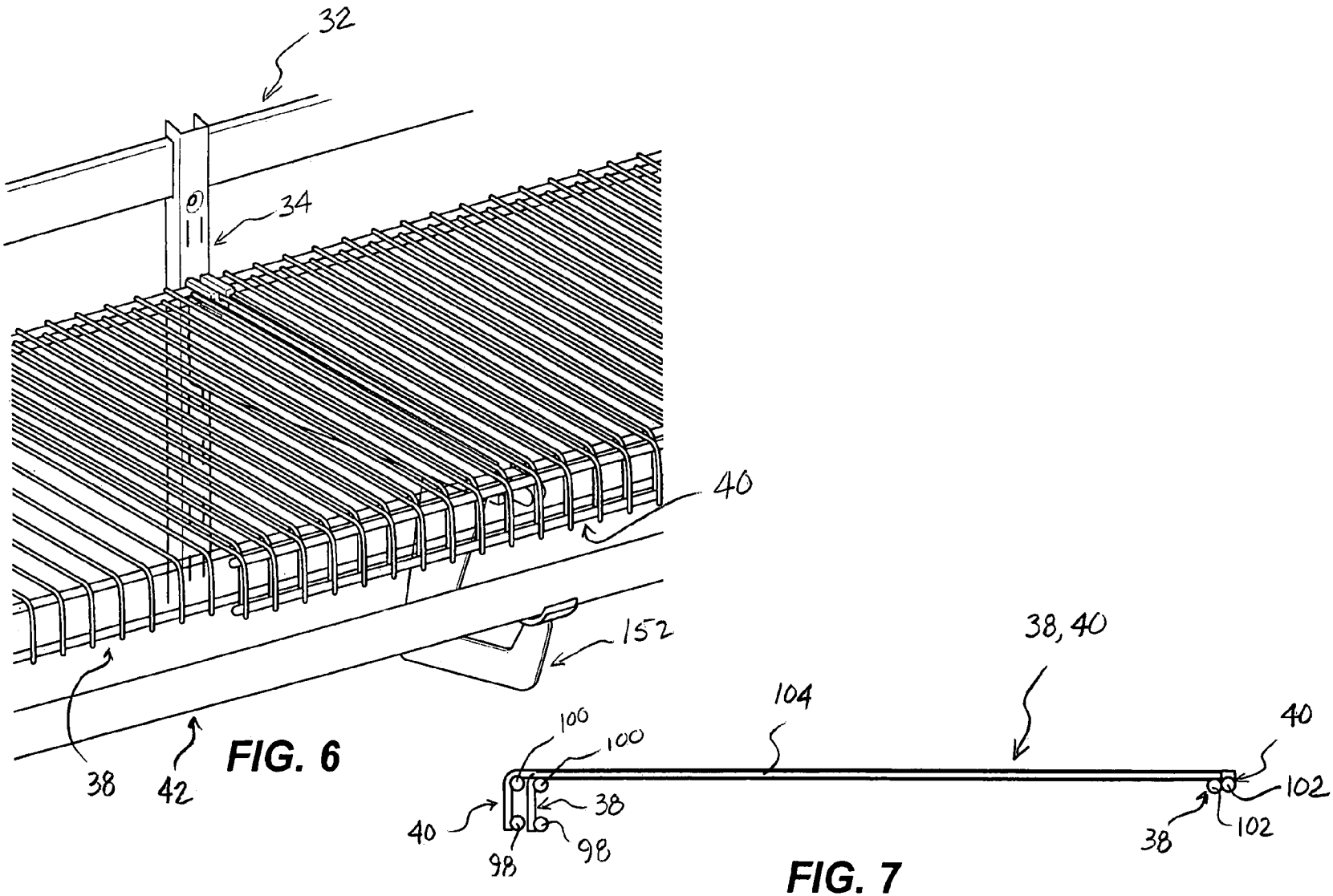
FIG. 6 shows an enlarged top perspective view of a shelf portion and shelf mounting arrangement of the organizer system shown in FIG. 1.
FIG. 7 shows an end view of the overlapped shelves as shown in FIG. 6.

As shown in FIGS. 6 and 7, the shelves 38 and 40 are essentially identical in construction, except that they are slightly different in relative size. Each of the shelves 38 and 40 is essentially identical in structure has a side-to-side length or width and a shelf depth from forward to rear end. Each shelf in the disclosed example has a pair of elongate wires 98 and 100 that are the forward end wires. The wires 98 and 100 are spaced vertically apart and parallel to one another and extend the length or width of the shelf. The spacing of these two wires 98 and 100 define a shelf height. In the disclosed example, each shelf also includes an elongate single wire 102 that is the rear end wire. The rear end wire also extends along the shelf length, is generally parallel to the wires 98 and 100, and defines a rear end of the shelf. The gap between the upper most wire 100 of the front wires and the rear wire 102 defines the depth of the shelf. The length of the wires 98, 100, and 102 generally define a length or width of the shelf.

Each shelf 38 and 40 also has a plurality of closely spaced apart transverse wires 104 positioned in this example generally perpendicular or normal to the elongate wires 98, 100, and 102. These wires 104 are at one end attached to the rear wire 102, such as by welding, and extend forwardly from the rear wire. These wires 104 in this example are then bent at a forward end over the upper most front wire 100 downward toward and connect to the lower front wire 98. The forward end of the wire 104 is attached to each of the wires 98 and 100, also such as by welding. The wires 104 are described herein as being transverse to the longitudinal direction and are therefore identified as the transverse wires, though they extend front to back relative to the shelf orientation. These transverse wires 104 define a support surface 108 on which items can be stored on the shelves 38 and 40.

As shown in FIG. 7, the smaller shelves 38 are sized to fit within the larger shelves 40. Thus, portions of two adjacent shelves 38 and 40 can overlap one another. The transverse wires 104 of overlapped shelves will sit side by side in the same plane. The rear wires 102 of overlapped shelves will sit horizontally adjacent one another, as will the front wires 98 and 100, as shown in FIG. 7. With this construction, a shelf can be constructed using alternating shelves 38 and 40 that has virtually any length or width from a minimum of one single shelf length or width to any longer length. For each shelf 38 and 40, the bent portions of the wires 104 depend downward and, together with the wires 98 and 100, provide structural rigidity to the shelf.

Figure 8:
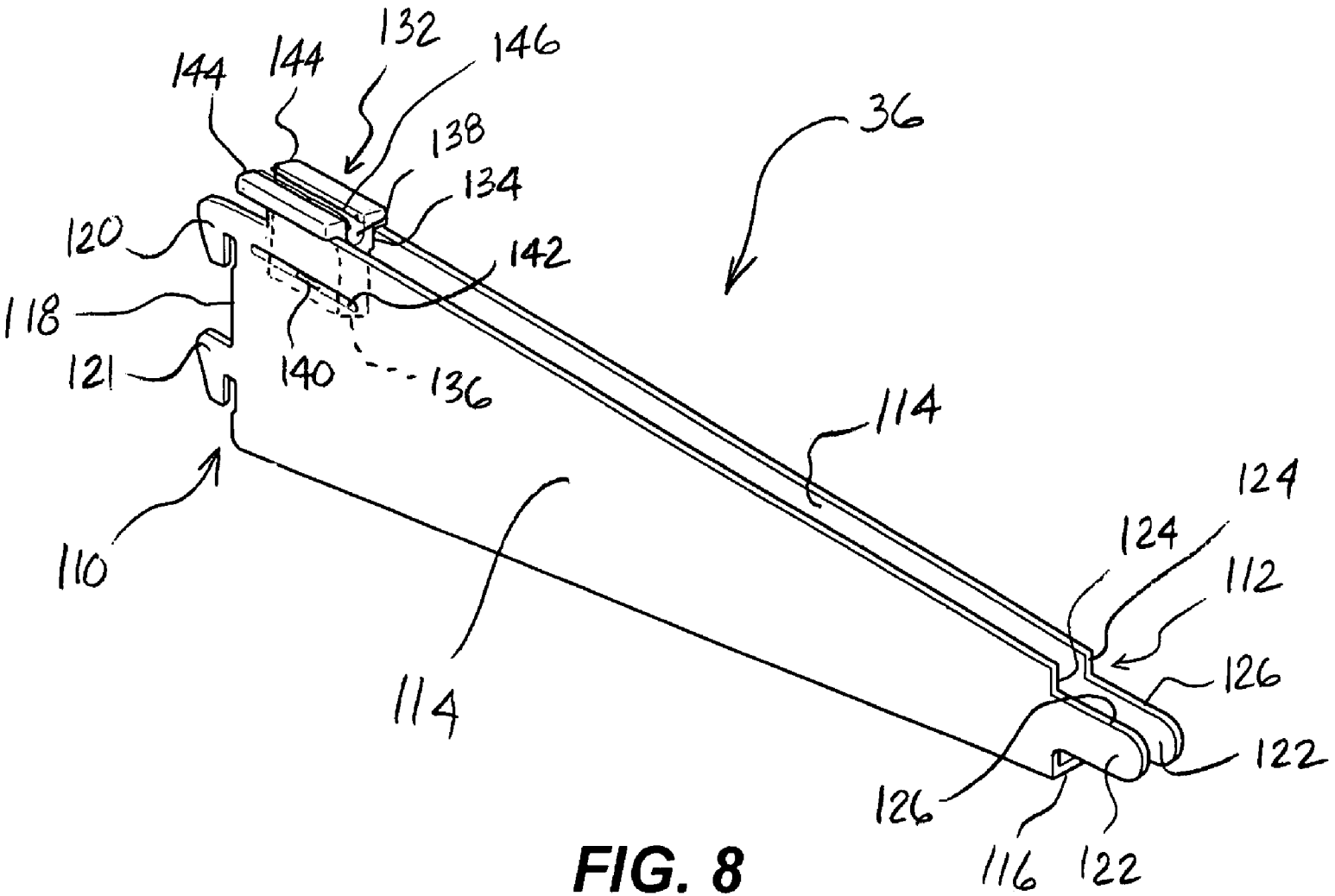
FIG. 8 shows a perspective and exploded view of a shelf mounting bracket of the organizer system shown in FIG. 1.

FIG. 8 illustrates the majority of the construction of the shelf mounting brackets 36. Each bracket 36 has a generally triangular configuration in side profile with a rear end 110 and a forward end 112. The rear end 110 is taller than the forward end 112 to form a buttress-like shelf supporting structure. As shown in FIG. 8, the bracket 36 in the disclosed example has a generally tall and thin U-shaped configuration with an open top and a closed bottom. A pair of spaced apart sides 114 of the bracket 36 are connected along an integral bottom surface 116. Each side 114 has a back edge 118 defining part of the bracket back end 110. A pair of vertically spaced apart and downwardly extending L-shaped hooks extend from each back edge 118. Thus, as can be gleaned from FIG. 8, each bracket 36 includes a pair of laterally spaced upper hooks 120 and a pair of laterally spaced lower hooks 121 at the rear end 110 of the bracket. The placement of the hooks correspond in lateral spacing and in vertical spacing to the positioning of the apertures 78 in the vertical uprights 34.

Also as can be seen in FIG. 8, each bracket 36 in the disclosed example includes a pair of forwardly extending fingers 122, one each extending from a forward edge 124 of a respective side 114 of the bracket. A top surface 126 of the fingers 122 defines a shelf support for the shelves as described below. As will be evident to those having ordinary skill in the art, the material for forming the brackets 36 can vary and yet fall within the spirit and scope of the invention. In one example, the brackets 36 are formed from flat metal sheets, stamped to include optional structural ribs, ridges, or depressions (not shown) in the sides 114, and then bent to form the bottom 116 and the spaced apart sides 114. The brackets can then be suitably plated, painted, or otherwise coated as desired to achieve a particular surface finish and esthetic appearance. Alternatively, the brackets can be constructed as a solid piece, as a bent metal welded structure, as a plastic molded structure, or any other suitable structure.

Also as shown in FIG. 8, a locking clip 132 is installed in each bracket 36 in this example. Each locking clip 132 generally has a clip body in U-shaped configuration with a pair of upstanding sidewalls 134, a bottom wall 136, and a wire receiving, open ended channel 138 defined between the sidewalls. In this example, each sidewall 134 also has a laterally outward projecting elongate rib 140. Each bracket side 114 has a corresponding elongate slot 142 that is greater in length than each of the ribs 140. The clip is inserted through the open top between the sidewalls 114 in the bracket 36 with the open top of the channel 138 facing upward. Each rib 140 is received in a corresponding one of the slots 142. Because the ribs are shorter in length than the slots, the clip can slide back and forth relative to the bracket. Each clip 132 also has a pair of rearward extending projections 144, one from each sidewall 134. When installed, the projections 144 face toward the rear end 110 of the bracket 36. Each clip can further have a pair of detent ridges 146 that extend inwardly toward one another into the channel, one each from each sidewall 134 at the channel opening.

The previously described components of the system 30 are the basic components of the organizer system. In one example, to assemble a bare bones organizer system in accordance with the teachings of the present invention, one would require two upper upright segments 70, one top rail segment 60, two shelf brackets 36, and one shelf 38 or 40. The single top rail segment 60 can be mounted horizontally level to a mounting surface and secured by conventional fasteners through the openings 64 to that surface. The two upper segments 70 can then be suspended from the top rail by hooking the tabs 86 of the cutouts 82 over the rail support leg 63 and suspended therefrom. If desired, one or more fasteners can be utilized through the available fasteners openings 79 in the uprights 70 to further secure the uprights to the mounting surface in a vertical orientation.

The L-shaped hooks 120 and 121 of a bracket 36 can be placed in selected apertures 78 in the upright segments 70. First, a bracket 36 is held horizontally and moved toward an upright segment 70. Once the L-shaped hooks 120 and 121 are passed into and through the selected apertures 78, the mounting bracket 36 can be dropped or pushed downward into position such that the hooks 120 and 121, and corresponding notches formed thereby, interlock with the material of the upright 70 beneath the selected apertures. The second bracket 36 can be similarly mounted to the second short segment 70 at the same elevation. A shelf is then positioned over the mounting brackets such that one of the transverse wires 104 is captured between the fingers 121 of each bracket 36.

Figure 9B:
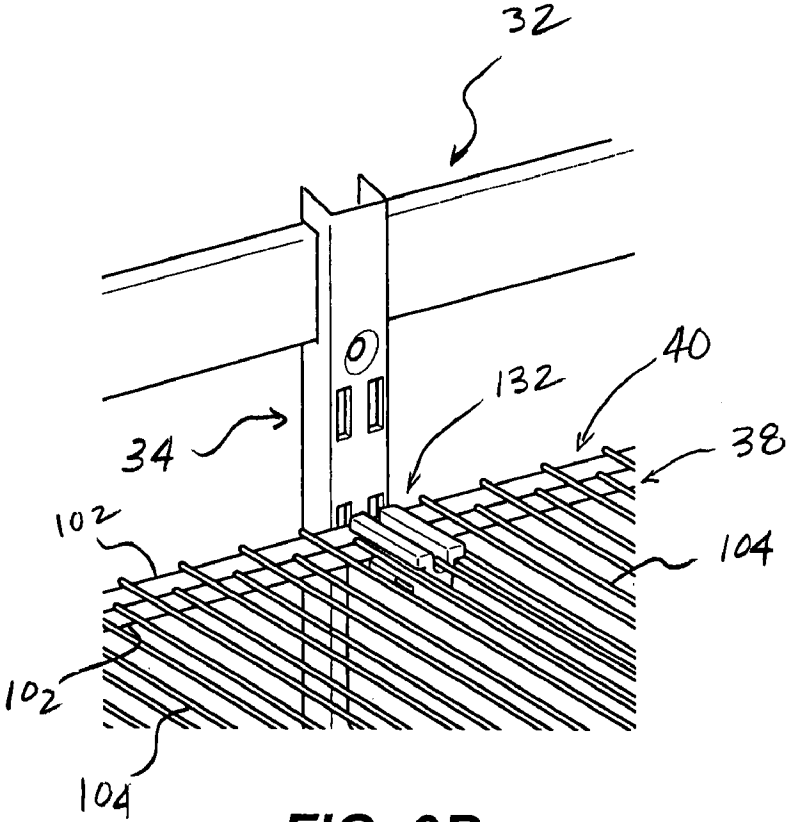
FIGS. 9A and 9B show an enlarged view of a portion of a shelf mounting bracket and installed shelf of the organizer system shown in FIG. 6 with the clip in a locked position and in an unlocked condition, respectively.
Figure 9A:
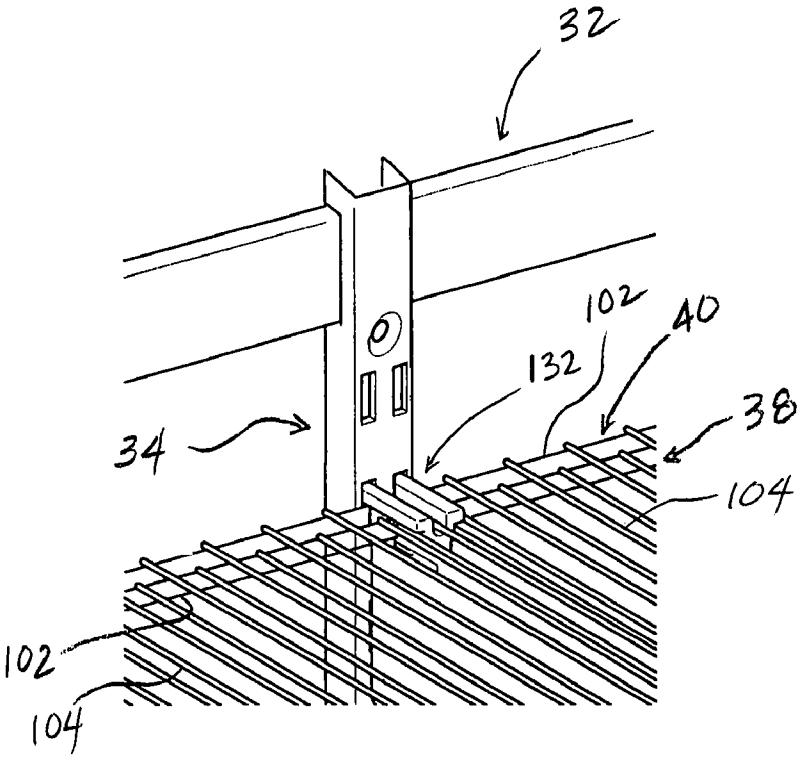

As shown in FIGS. 9A and 9B, the same transverse shelf wire 104 is also received in the channel 138 of the clip 132 near the rear wire 102. The clip is in the unlocked position shown in FIG. 9B. The wire 104 in this example is snapped through the detent ridges 146 and into the channel 138. When the shelf 38 is dropped into position, the bracket clip 132 is then slid rearwardly such that the tabs 144 pass into the adjacent apertures 78 in the respective upright 70. The channel 138 depth and tab 144 length is such that, when the wire 104 is fully seated, the tabs will overlie the wire 102 when locked. The tabs 144 and slots 142 are of such a length that they will do so whether one shelf is present at the bracket or two overlapped shelves, and thus two rear wires, are present. The clip 132 and the fingers 122 at least loosely secure the shelf in place. The shelf can thus not be easily lifted from this installed position.

In another example, to assemble a larger scale organizer system, two or more of the top rail segments 60 can be assembled overlapping one another over at least a portion of their respective lengths to achieve a desired length for a completed top rail 32. As shown in FIG. 3, a string or series of top rail segments 60 can be extended across a width of a storage space. One end of a first segment 60 can be horizontally oriented and abutted, if desired, against a wall adjacent the mounting surface. Additional segments 60 can then be horizontally overlapped to achieve the desired length. The top rail segments 60 can then be secured utilizing conventional fasteners through the openings 64.

In this example, the covers 62*a* and 62*b* are utilized. A first one of the covers 62*a* (i.e., the short cover) is then secured, as described above, to the first installed top rail segment 60 abutting the adjacent wall of the storage space. In one example, this cover 62*a* is about six (6) inches in length. A first one of the upper upright segments 70 is then installed over the top rail 32 abutting the distal or exposed end of the short cover 62*a*, and thus is positioned about 6 inches from the adjacent wall. To achieve proper spacing of the remaining uprights 34 in this example, the longer covers 62*b* are utilized as spacers. In one example, each of the covers 62*b* is about twenty-three (23) inches long to provide 24 inch spacing (including the width of adjacent one inch wide uprights 34) between uprights. Thus, the sequence for installing a larger scale organizer is to mount the top rail 32, attach the short cover 62*a*, attach one of the upper upright segments 70, and then in sequence attach a longer cover 62*b*, another upright segment 70, repeating the sequence as needed. Once all the desired upper segments 70 are hung, they can be secured with fasteners as needed.

The covers, shelves, and rails can be sized to require any desired standard spacing, and are not limited to any particular dimensions. The two-foot spacing described herein is simply for illustration purposes. Further, as will be evident to those having ordinary skill in the art, not all storage spaces will permit the same two-foot spacing (as used in this example) between every adjacent upright. The disclosed invention is highly adjustable to accommodate this problem without requiring cutting of shelves, rail segments, uprights, or any other part. Where a smaller spacing is required (see FIG. 1, right hand side), the overlapping capability of the shelves 38 and 40 and the rail segments 60, each described earlier, permits adjusting the components to fit virtually any space larger that a minimum one shelf width space.

To complete installation of the larger scale organizer system 30, additional supplemental upright segments 72 are then installed as described above to the previously mounted shorter upper segments 70 in order to provide a desired length for the vertical uprights 34. Each upright 34 need not be the same length, depending upon the needs of a particular customized storage space. One or more of the interior or outer most uprights 34 can be shorter or longer in length to accommodate different storage space configurations as well as different configurations for the organizer unit.

A plurality of shelf mounting brackets 36 can then be attached where desired to the installed uprights 34. Shelves 38 and 40 can then be installed on the mounting brackets 36 as described above to complete the basic component installation. Where needed, a shelf 38 can be overlapped to any degree necessary by a shelf 40 to adjust shelf width or length to fit a given space. The construction of the shelves 38 and 40 permits any shelf width from a minimum width equal to a width of a single shelf 38 or 40 to any desired maximum width. The overlapping nature of the shelves 38 and 40 permits adjustment of a particular shelf to any length larger than the minimum and maximum. This is particularly useful where the maximum standard spacing of 23 inches between uprights can not be achieved in a given storage space. One or more of the uprights 34 may need to be installed closer to its adjacent upright, such as shown in FIG. 1, right hand side. A consumer need not cut any component of the system, other than a cover 62*b* to fit the smaller upright spacing. Instead, they can simply overlay a portion of one larger shelf 40 on top of an adjacent smaller shelf 38 to the degree necessary to provide the desired shelf width.

Figure 10:
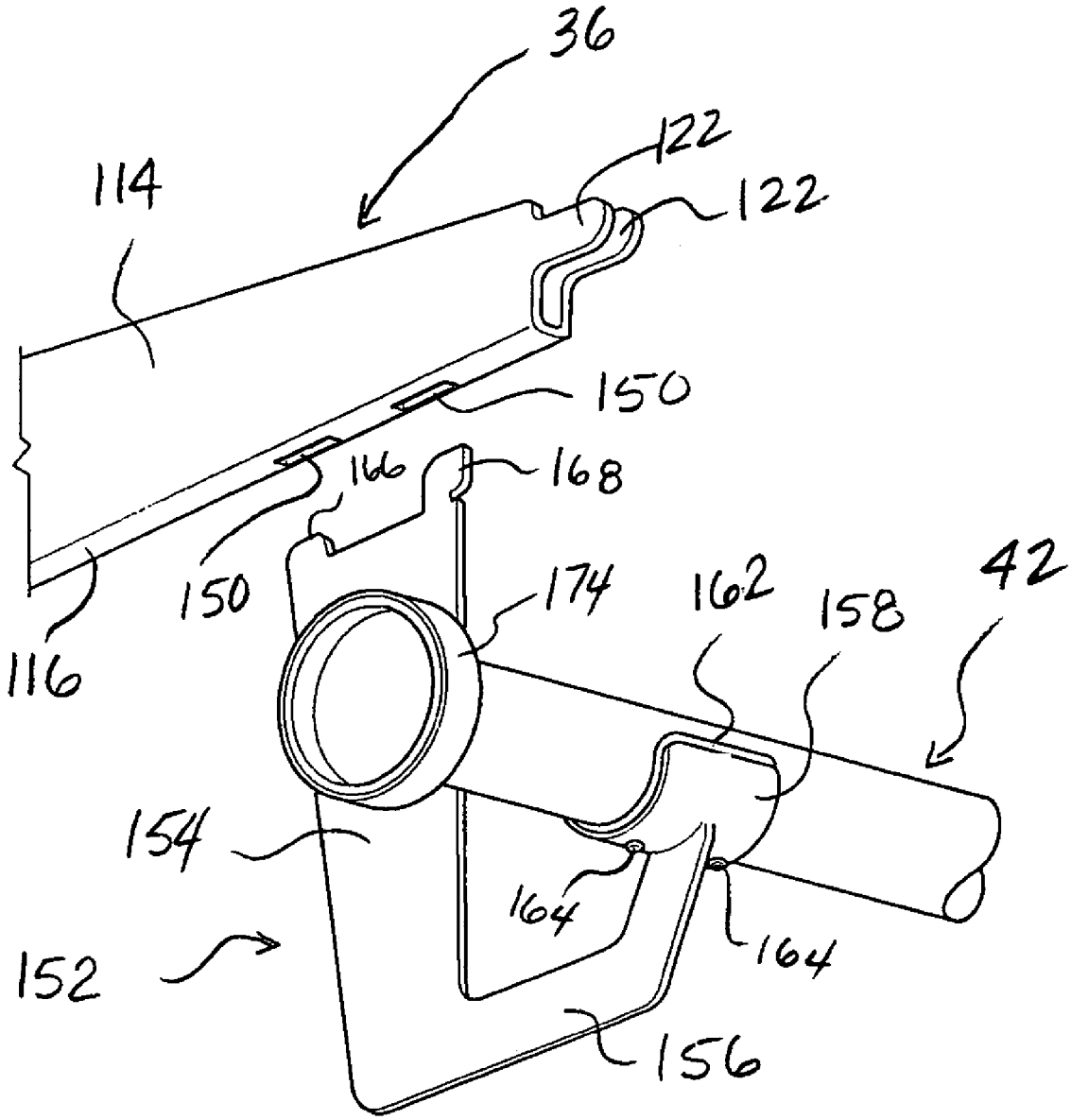
FIG. 10 shows a bottom perspective and partially exploded view of a clothes hanging rod and support bracket accessory for the organizer system shown in FIG. 1 and constructed in accordance with the teachings of the present invention.

As illustrated in FIGS. 1, 2, and 10, one example of an accessory that can be optionally added to the disclosed organizer system 30 is a clothes hanging rod 42. In one example, the shelf mounting brackets 36 are provided with a pair of slots 150 in the bottom surface 116. The slots 150 in this example are oriented in a longitudinal direction and spaced apart from one another in the bracket 36. A rod mounting bracket 152 can be attached to each of the brackets 36 or to any one of the selected brackets as needed.

In this example, the rod support bracket 152 includes a bracket body having a J-shape with an elongate support arm 154 and a lower hook portion 156 that extends from a lower end of the support arm 154 and curves back upwardly in a direction toward the bracket 36 and in a forward direction relative to the bracket 36. A distal end of the curved hook section 156 terminates at a curved, semi-cylindrical receiver 158 that, in the present example, is shaped to conform with a cylindrical clothes hanging rod configuration. The receiver can be integral to or attached, such as by welding, to the hook section 156 as needed. As will be evident to those having ordinary skill in the art, the receiver 158 can take on any number of configurations and constructions, and particularly, it is best to accommodate the particular shape of a clothes hanging rod. In this example, the rod 42 is a circular cylinder. Thus, the receiver provides a semi-cylindrical surface for supporting the rod.

In this example, each receiver is provided with a pair of through holes (not shown). A soft, flexible bearing insert 162 is provided having a shape that essentially mirrors that of the receiver 150 in this example. A bottom surface of the bearing insert 162 includes a pair of downwardly projecting plugs 164 that are sized to be forceably received through the holes 160 of the receiver to hold and retain the insert in the receiver. The receiver insert 162 is an optional component as well, but can be provided to permit flex in the system and to prevent wear of components bearing on one another. Further, the bearing insert 162 can help to eliminate scraping of surface to surface contact, such as between a metal rod and a metal receiver.

An upper end of the support arm has an upwardly projecting tab 166 positioned rearward of an upwardly projecting and forwardly extending L-shaped catch 168. The catch 168 is configured to be received, with the bracket 152 positioned in a forward tilt, in a forward one of the slots 150 in the bottom of the shelf mounting bracket 36. The bracket 152 is then rotated so that the tab 166 is received in the rearward slot 150 in the bracket 36. The rod 42 weight and the geometry of the J-shaped bracket 152 causes the bracket to swing rearward and upward, which retains the rod bracket 152 in its installed orientation.

As illustrated in FIG. 2, for example, a plurality of the J-shaped brackets 152 can be installed from horizontally adjacent and spaced apart mounting brackets 36 in order to support a clothes hanging rod 42 in any location on the organizer system 30 desired. In the example disclosed herein, the clothes hanging rod 42 includes a pair of telescoping segments 170 and 172 so that the clothes rod can also be length adjustable between a length essentially equal to one of the two segments to a length of nearly the entirety of the two segments.

In the disclosed example, the clothes hanging rod segments 170 and 172 are constructed from slightly different diameter hollow tubes that can telescope relative to one another. If needed, the open ends of the hollow tube segments 170 and 172 can be covered by decorative and/or safety caps 174. The caps can be configured to secure in any known manner. For example, a circular ring can be provided on one end of each cap so that the caps fit snuggly over the exposed ends of the rod segments 170 and 172. A clothes hanging rod 42 accessory can be installed spanning only a single shelf width or multiple shelf widths. Further, multiple rods 42 can be installed at more than one lateral position and/or more than one elevation in an organizer system disclosed herein.

Figure 12:
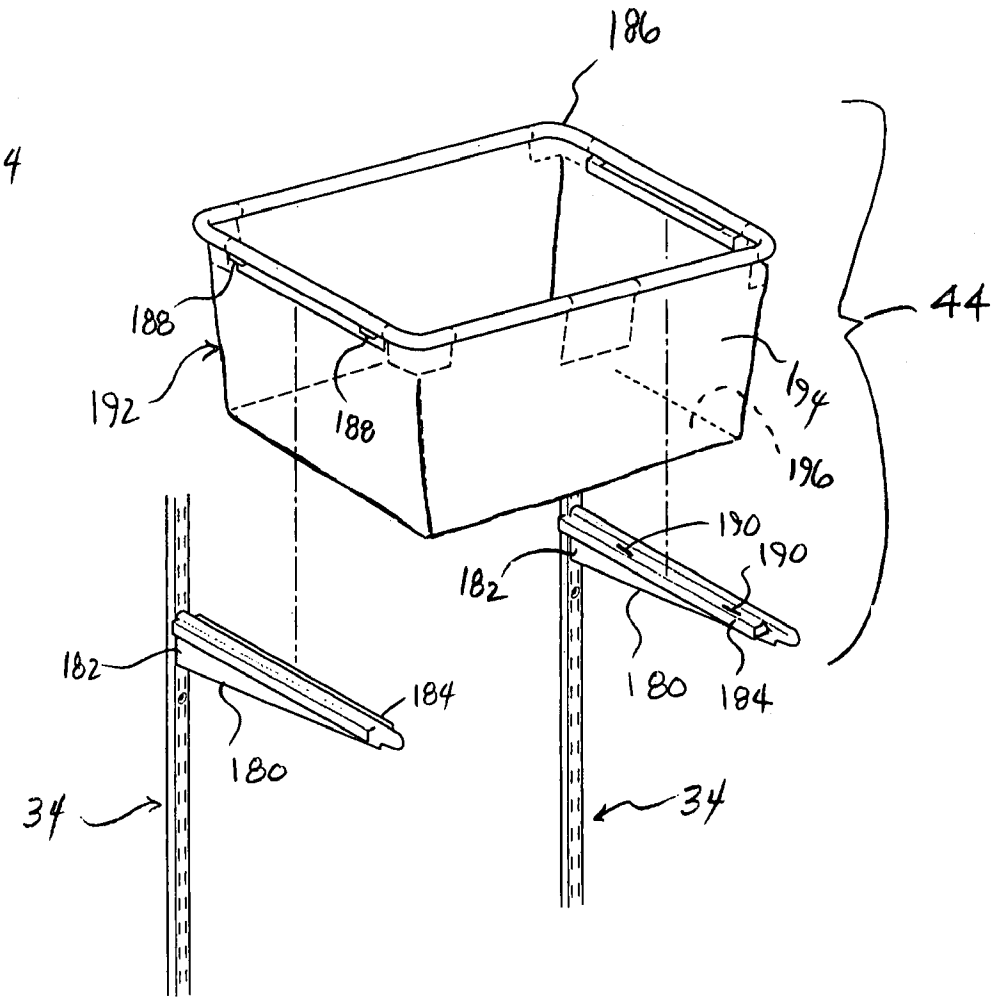
FIG. 12 shows a perspective and partially exploded view of the storage basket accessory as shown in FIG. 11.
Figure 11:
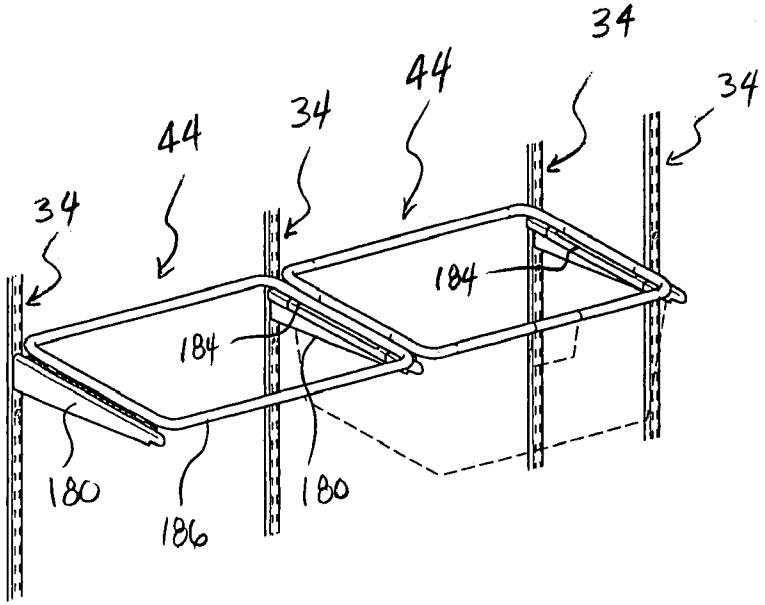
FIG. 11 shows a perspective view of portions of a mounting arrangement for a sliding storage basket accessory of the organizer system shown in FIG. 1 and constructed in accordance with the teachings of the present invention.

As shown in FIGS. 1, 11, and 12, an example of another optional accessory is the storage basket accessory 44. FIGS. 1 and 11 illustrate a pair of adjacent basket accessories 44. Only one will be described herein. In this example, a pair of basket mounting brackets 180 are mounted to adjacent ones of the uprights 34. Though not shown, the brackets 180 include a rear end 182 having vertically spaced apart pairs of attachment hooks constructed, in one example, identically to the hooks 120 and 121 of the shelf brackets 36. The brackets 180 can thus be mounted at any location desired on the uprights.

As an option, each bracket 180 can have a roller-type sliding track 184 attached to an inner side facing the opposed bracket 180. A basket support frame 186 in this example is suspended from or mounted to the slide track 184 of the bracket. In this example, the frame 186 is horizontally oriented and is a rectangular shaped tubular construction. Attachment tabs 188 are provided on the lateral sides of the support frame 186 for being received in slots 190 in the tracks 184. When the frame 186 is pulled forward away from the mounting surface in the direction of the arrows, the tabs 188 stay in the slots 190 and draw the slide track forward making the basket accessory more accessible to the user.

The storage basket accessory 44 also has a basket 192 suspended from the frame 186 in this example. The basket 192 has a perimeter side wall 194 and a bottom wall 196 defining a storage space with depth for storing items. The basket 192 can be made from woven fabric, mesh fabric, flexible plastic, substantially rigid plastic, or any other suitable material. A fabric or flexible basket 192 can include an optional rigid bottom panel (not shown) that sets on the bottom wall to conform and hold a desired shape of the storage space within the basket. No matter the construction, the frame 186 and/or the basket 192 must have a means for suspending the basket from the frame in this example. For a fabric basket, openable flaps can be formed on the upper edges of the basket 192 that can be received and secured over the tube frame. Any suitable means can be used to secure the flaps such as snaps, hook and loop fastener material, zippers, or the like.

As will be evident to those having ordinary skill in the art, the basket 192 and brackets 180 can alternatively be formed as a single integral component that mounts directly to one or more of the uprights. Alternatively, the basket can be formed as a simple structure, either rigid or flexible, that hooks onto or rests on a portion of the one or more simple mounting bars or rods that are suspended from one or more uprights 34. The brackets 180 need not include a slide feature. As a further alterative, the mounting brackets can include a bearing surface over which a mating surface of a basket can slide. Such a basket can be slid along the brackets providing easier access to the storage space, and yet would be simple to manufacture, construct, and use because it would not include separate roller tracks.

Figure 13:
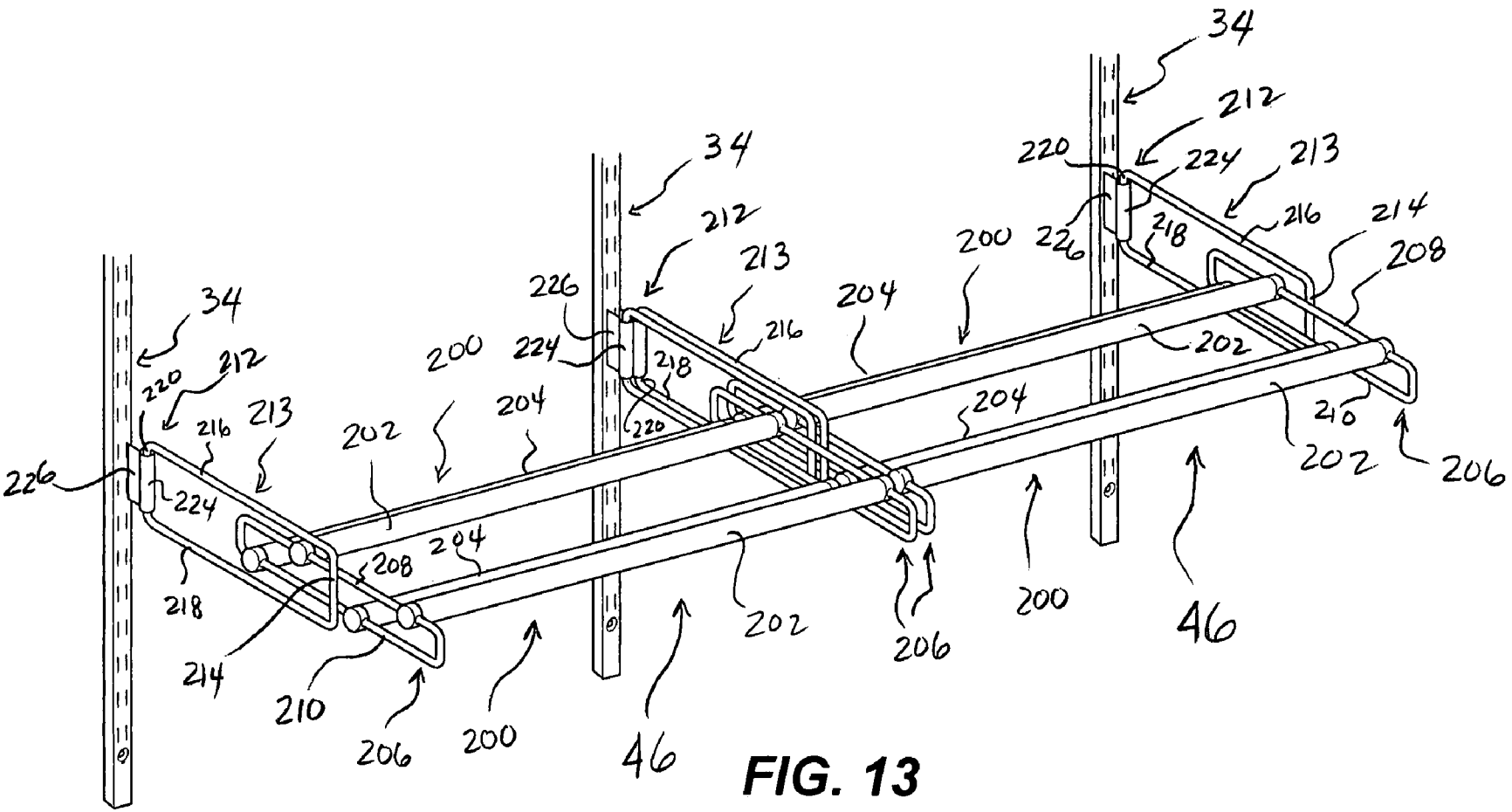
FIG. 13 shows an enlarged perspective view of a shoe rack accessory of the organizer system shown in FIG. 1 and constructed in accordance with the teachings of the present invention.

As shown in FIGS. 1 and 13, an example of another optional accessory is the shoe tube or rack accessory 46. The shoe rack 46 in this example is again illustrated as two adjacent, identical racks. Only one will be described. The shoe rack accessory 46 has a pair of laterally extending shoe supports 200, one spaced rearward of the other. Each shoe support 200 has an upper heel stop bar 202 and a lower sole support bar 204 spaced rearward of and parallel to its corresponding upper heel stop bar. The distal ends of each bar 202 and 204 are secured to opposed sub-frames 206. Each sub-frame 206 is a rectangular shaped wire or tube having an upper rung 208 and a lower rung 210 spaced from the upper rung. The sub-frames are oriented in a vertical plane in this example with the longer dimension along a horizontal axis. The upper heel stop bars 202 are affixed to the upper rung 208 and the lower sole support bars 204 are affixed to the lower rung 210. The bars can be welded to the sub-frames, or can have openings through which the sub-frame is received prior to closing the wire loop.

When a shoe is placed on the rack, the shoe heel should overhang the heel stop bar 202 and the shoe sole should rest on the support bar 204. The position and height difference between the bars 202 and 204 tilt the shoe with the toe downward and toward the system mounting surface.

Each sub-frame 206 is affixed to a mounting bracket 212 which is in turn suspended from an upright 34. The mounting brackets 212 can be any one of many different possible constructions. The brackets 212 illustrate another example of a suitable bracket construction adapted for use with the disclosed organizer system 30. In this example, each bracket 212 has a frame 213 that is a larger rectangular wire tube than the sub-frames. The frames 213 are also oriented in a vertical plane with its long dimension horizontal. Each bracket frame 213 has a front vertical cross bar 214 to which one of the sub-frames is affixed, such as by welding. The cross bar 214 connects forward ends of upper and lower rungs 216, 218 of the bracket frame 213. A rear cross bar 220 connects rearward ends of the rungs 216, 218 to complete the frame 213 loop.

A bracket coupling has a sleeve 224 received over the rear cross bar 220. A plate 226 extends rearward from the sleeve. Though not shown, the plate has a pair of vertically spaced hooks each identical to one of the hooks 120 and 121. The hooks are attached as shown in FIG. 13 to a single row pair of apertures 78 in an upright 34 for mounting the bracket 212. Each bracket 212 and sub-frame 206 is identically mounted and constructed for each rack 46. As with the basket accessory 44, each rack 46 can be mounted to the uprights at any desired location along the uprights 34.

Figure 14:
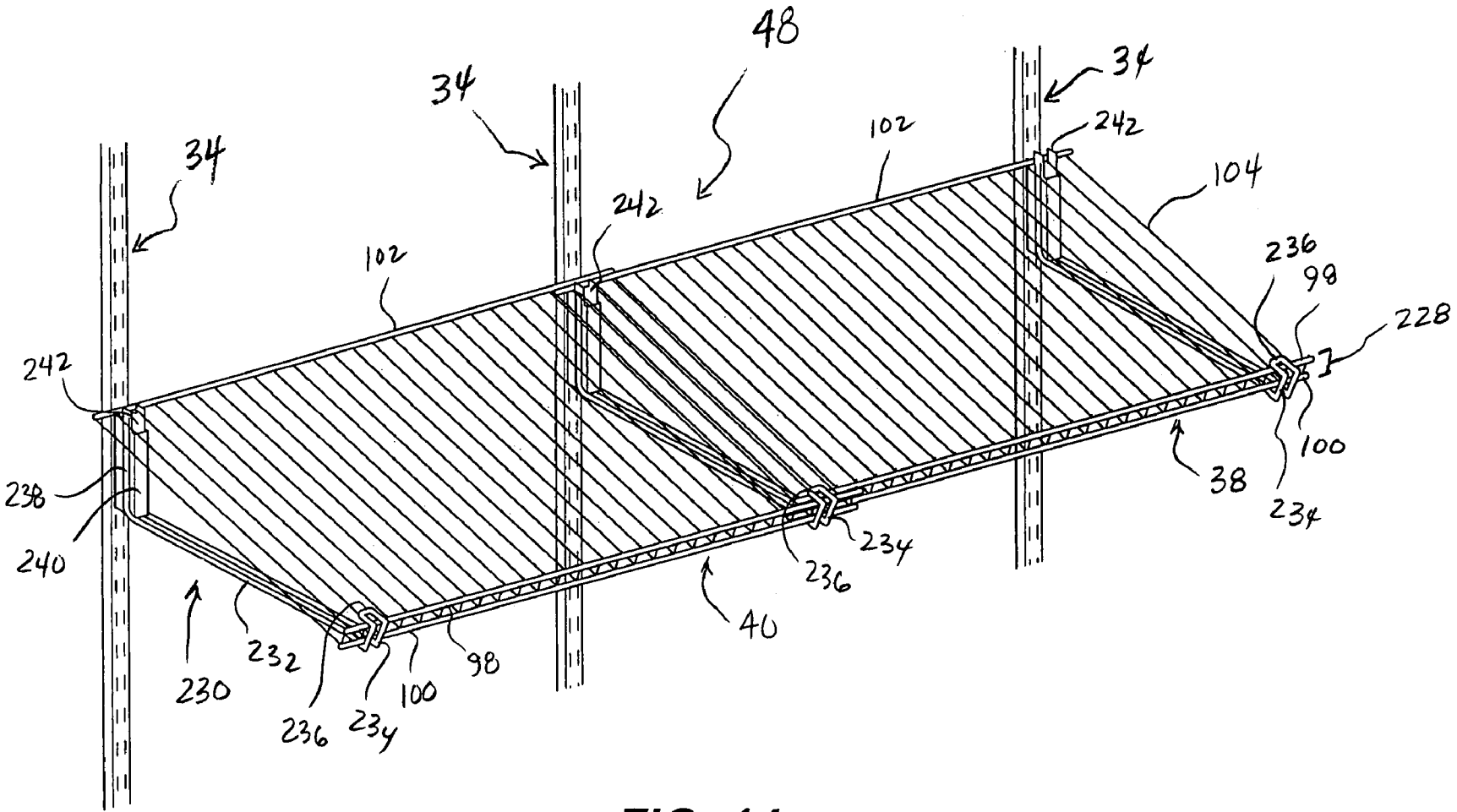
FIG. 14 illustrates an enlarged perspective view of a shoe shelf accessory of the organizer system shown in FIG. 1 and constructed in accordance with the teachings of the present invention.
Figure 15B:
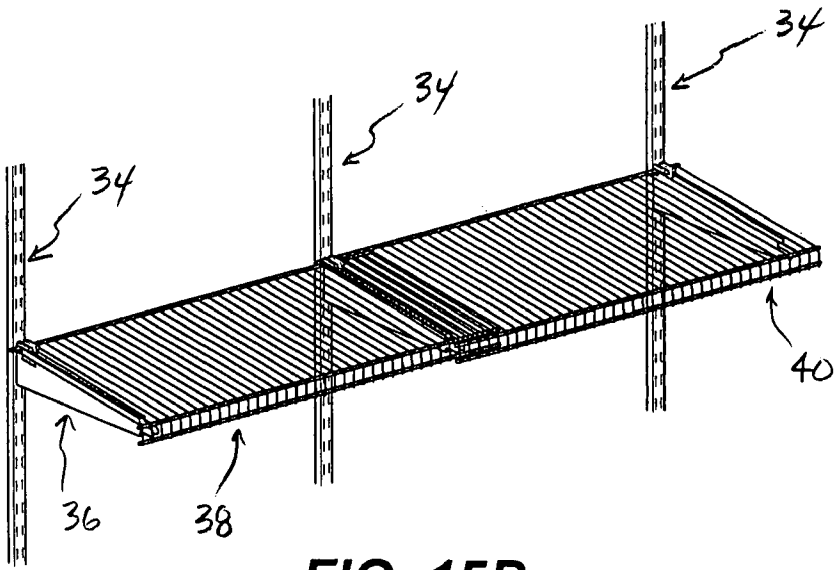
FIGS. 15A and 15B illustrate at least two of many possible shelf arrangements for the organizer system shown in FIG. 1.
Figure 15A:
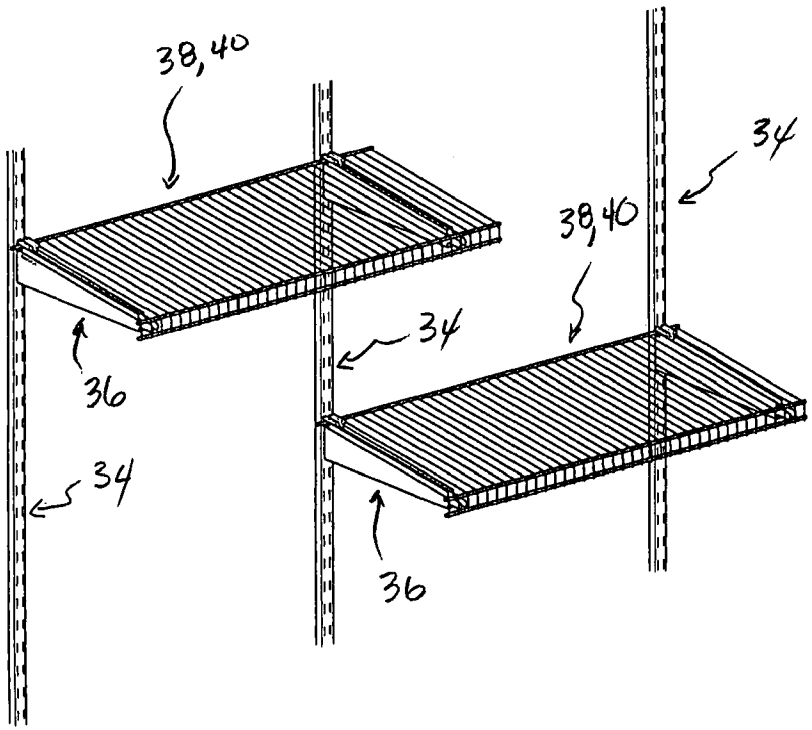
Figure 16B:
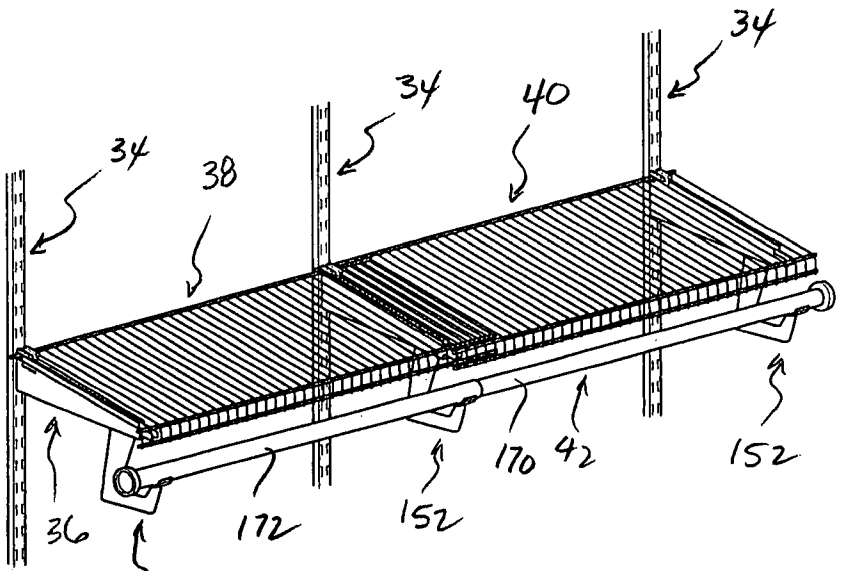
FIGS. 16A and 16B illustrate two of many different shelf and clothes hanging rod arrangements for the organizer system shown in FIG. 1.
Figure 16A:
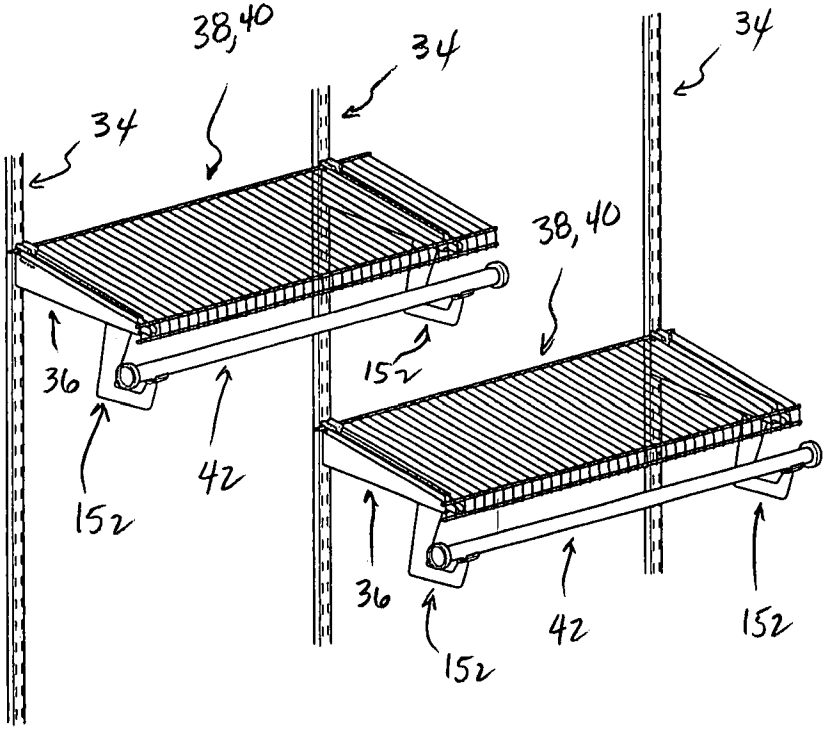

As shown in FIGS. 1 and 14, an example of another optional accessory is the shoe shelf accessory 48. FIGS. 1 and 14 illustrate that, in this example, the shoe shelf 46 includes one of each of the shelves 38 and 40 utilized in an inverted and overlapped arrangement. The front ends and rear ends are in the same general position, but the shelf is inverted such that the forward wire 98 is positioned above the forward wire 100. The bent portions of the transverse wires 104 now extend upward and in combination with the wire 98 define a shoe barrier 228 in this example.

The shelf is supported in this example by a plurality of shoe shelf brackets 230. Each bracket supports the rear end of the shelf at a higher elevation than the forward end. Thus, shoes stored on the shelf will be tilted toward a user and easily visible and accessible. However, the shoe barrier 228 prevents the shoes from sliding off of the shelf.

Each bracket 230 in this example has a wire formed support 232 with a forward end 234 that is upturned at an angle that corresponds to the tilt angle of the barrier 228. A turned back tip 236 extends from the end of the upturned end 234 and captures the barrier portion of the shelf. The support 232 has a vertical wire connector 238 hung from or coupled to a bracket coupling 240 that is attached to an upright 34. A shelf catch 242 extends upward from the coupling 240 and is spaced away from the front surface of the upright 34 creating a space. The rear shelf wire 102 is captured between the catch and the upright on top of the coupling to support the rear end of the shelf. Again, the coupling 240, though not shown, has appropriate mounting hooks, such as the hooks 120 and 121 of the bracket, for mounting the coupling to an upright 34. FIG. 14 illustrates a pair of overlapped shelves 38 and 40 to illustrate that the shoe shelf accessory 46 is also adjustable in length or width as needed.

Returning to FIG. 1, yet another example of an optional accessory is the vertical slider accessory 50. In this example, the vertical slider 50 has a pair of elongate brackets 250 mounted and spaced vertically apart along the same upright 34. Each bracket 250 again has hooks, though not shown, for suspending them from the upright. A vertical tubular frame 252 is configured in this example in a rectangle shape is suspended between the pair of brackets 250. The frame 252 can be attached to the brackets 250 in any suitable manner. A fabric or mesh material 254 with storage receptacles 256 is suspended from the frame 252 within the frame interior space.

Though not shown herein, the brackets 250 can alternatively include slide tracks to permit the vertical accessory to be slid outward away from the mounting surface for easy access to the receptacles. Further, the storage receptacles can be replaced by a myriad of other storage options suspended from the accessory frame and/or brackets. The depicted accessory is only one of many possible arrangement. The vertical slider could be adapted to store books, magazines, ties, pants, tools, or many other types of objects as desired.

FIGS. 15A-16B are provided to depict only a few of many different arrangements and configurations that can be achieved by the disclosed organizer system. The arrangement of shelves can be side by side or staggered. The clothes rod accessory 42 can be mounted to side by side shelves, staggered shelves, or only a single shelf. The organizer system and components are highly versatile, easily adjustable and re-adjustable before, during, or even after installation of the basic mounting components.

Although certain organizer systems and methods have been disclosed and described herein in accordance with the teachings of the present disclosure; the scope of coverage of this patent is not limited thereto. On the contrary, this patent covers all embodiments of the teachings of the disclosure that fairly fall within the scope of permissible equivalents.

What is claimed is:

1. A storage organizer system comprising:

a width adjustable horizontal top rail, wherein the top rail includes a plurality of support rail segments, the support rail segments sized and shaped to permit a pair of the support rail segments to be overlapped to form a top rail having a first length, and further to permit the pair of support rail segments to be abutted to form a top rail having a second length longer than the first length;

a plurality of vertical uprights that are height adjustable and mounted spaced apart along the top rail;

a plurality of mounting brackets each attached to one of the vertical uprights at selected locations; and a plurality of shelves, each of the plurality of shelves including at least one support wire defining a bottom of the shelf and extending along a width of the shelf, each shelf further including a plurality of transverse wires defining a support surface, the transverse wires extending along a depth of each shelf, the plurality of shelves supportable on the mounting brackets, wherein a first one of the shelves may be overlapped over a second one of the shelves to create a combined shelf having a combined shelf width, the combined shelf width adjustable between a first combined shelf width and a second combined shelf width, the first combined shelf width substantially equal to the width of the first one of the shelves, the second combined shelf width greater than the width of the first one of the shelves.

2. A storage organizer system according to claim 1, further comprising:

at least two rod brackets, each suspended from a respective one of the mounting brackets, each rod bracket having an upwardly facing rod support at one end; and a width adjustable rod supported on the rod supports beneath at least one of the shelves.

3. A storage organizer system according to claim 1, wherein the vertical uprights include at least a plurality of upper segments and a plurality of supplemental segments, the upper segments each having a top end configured to connect to and suspend from the top rail and having a lower end, the supplemental segments each having one end configured to connect with and suspend from the lower ends of the upper segments.

4. A storage organizer according to claim 3, wherein the upper segments are of a different height than the supplemental segments.

5. A storage organizer system according to claim 1, wherein overlapped ones of the plurality of shelves form a shelf support surface of wires that lie all in the same plane.

6. A storage organizer system according to claim 1, further comprising:

at least one storage accessory mounted to one or more selected ones of the vertical uprights and selected from an accessory group comprising a shoe storage shelf, a shoe storage rack, a clothes hanging rod, a vertical storage device, and a forward and rearward slidable storage device.

7. A storage organizer system according to claim 1, wherein the shelves are wire shelves and include a plurality of first wire shelves that can each overlap and nest with each of a plurality of second wire shelves.

8. A storage organizer system according to claim 1, wherein at the overlapped portion of the support rail segments an outer surface of a first support rail segment abuts a majority of an inner surface of a second support rail segment.

9. An adjustable organizer system comprising:

a width adjustable top rail assembly mountable to a mounting surface;

a plurality of vertical standards configured to suspend from the top rail at desired positions along the top rail;

a plurality of first and second wire shelves mountable to the vertical standards, each of the shelves formed from a plurality of wires including a front wire and a rear wire extending a width of the shelves, and transverse wires extending a depth of the shelves, the first wire shelves configured to nest and overlap with the second wire shelves such that an assembled shelf can be adjustably and selectively arranged having a desired width from a minimum width of one of the first or the second wire shelves to a selected width larger than the minimum width by intermittently overlapping and nesting one or more of the first wire shelves with one or more of the second wire shelves; and a plurality of mounting brackets, each of the mounting brackets attached to one of the vertical uprights at selected locations and adapted to simultaneously engage the front wire and the rear wire of two or more overlapped shelves of the plurality of shelves in a common plane.

10. An adjustable organizer system according to claim 9, wherein the plurality of vertical standards are height adjustable.

11. An adjustable organizer system according to claim 9, further comprising:

at least one storage accessory mountable to the vertical uprights and selected from an accessory group consisting of a shoe storage shelf, a shoe storage rack, a horizontal rod, a vertical storage device, and a forward and rearward slidable storage device.

12. An adjustable organizer system according to claim 9, wherein nested and overlapped ones of the plurality of shelves provide a shelf support surface formed of wires all lying generally in the same plane.

13. An adjustable organizer system according to claim 9, wherein the vertical standards further comprise:

a plurality of upper segments with upper ends and lower ends, the upper ends each configured to hang the corresponding upper segment from the top rail; and a plurality of supplemental segments each with at least one end configured to connect with and hang from the lower ends of the upper segments.

14. An adjustable organizer system according to claim 9, wherein the top rail further comprises:

a plurality of top rail segments, the top rail segments sized and shaped to permit a pair of the top rail segments to be overlapped to form a top rail having a first length, and further to permit the pair of top rail segments to be abutted to form a top rail having a second length longer than the first length; and a spacer segment sized to achieve a desired minimum distance for mounting the organizer system from an adjacent surface to the mounting surface, the spacer segment being shorter than the plurality of top rail segments.

15. An adjustable organizer system according to claim 9, wherein each of the mounting brackets further comprises:

front and rear support surfaces on which corresponding front and rear portions of the shelves can rest, each of the front and rear support surfaces configured to support portions of either one shelf resting thereon or two overlapped shelves resting thereon; and a slidable locking clip captured in the bracket near the rear support surface, the locking clip having at least one locking tab and being slidable between a locked position wherein the at least one locking tab overlies a wire of each wire shelf resting thereon and an unlocked position creating vertical clearance above the rear support surface.

16. An adjustable organizer system according to claim 9, wherein the standards are each provided with apertures in a front surface thereof, and wherein the mounting brackets each have one or more mounting hooks configured to be inserted into selected ones of the apertures to mount the brackets.

17. An adjustable shelving unit comprising:

a plurality of top rail segments mountable to a generally vertical surface and selectively mountable to a support surface in either an overlapping or an abutting relationship to achieve a top rail having a desired width greater than a width of any individual top rail segment;

a plurality of vertical upright segments sized and shaped to be suspended from the top rail at a selected spacing, at least some of the plurality of vertical upright segments also configured to suspend from another one of the plurality of vertical upright segments suspended from the top rail to achieve a height selected from at least two different heights;

a plurality of mounting brackets mountable to the vertical upright segments in selected apertures positioned spaced apart along the vertical upright segments; and a plurality of wire shelves mountable to the mounting brackets, each of the plurality of wire shelves configured to overlap with at least one other of the plurality of wire shelves to achieve a desired shelf width, wherein overlapped ones of the shelves provide a shelf support surface formed of shelf wires with each of the shelf wires lying generally within the same plane.

* * * * *